United States Patent [19]

Capek et al.

[11] Patent Number: 5,049,778

[45] Date of Patent: Sep. 17, 1991

[54] MASK SUPPORT STRUCTURE FOR TENSION MASK COLOR CATHODE RAY TUBES

[75] Inventors: Raymond G. Capek, Elmhurst; Lawrence W. Dougherty, Sleepy Hollow, both of Ill.

[73] Assignee: Zenith Electronics Corporation, Glenview, Ill.

[21] Appl. No.: 634,644

[22] Filed: Dec. 27, 1990

Related U.S. Application Data

[63] Continuation-in-part of Ser. No. 566,721, Aug. 13, 1990.

[51] Int. Cl.[5] ..... H01J 29/07; H01J 9/00

[52] U.S. Cl. ..... 313/407; 313/402; 313/408; 445/30

[58] Field of Search ..... 313/402, 407, 408; 445/30

[56] References Cited

U.S. PATENT DOCUMENTS

| | | | |
|---|---|---|---|
| 4,737,681 | 4/1988 | Dietch et al. | 313/402 |
| 4,745,330 | 5/1988 | Capek et al. | 313/407 |
| 4,790,786 | 12/1988 | Strauss | 445/30 |
| 4,828,523 | 5/1989 | Fendley et al. | 445/30 |
| 4,828,524 | 5/1989 | Fendley | 445/30 |
| 4,891,546 | 1/1990 | Dougherty et al. | 313/407 |
| 4,908,995 | 3/1990 | Dougherty et al. | 51/281 R |

*Primary Examiner*—Donald J. Yusko
*Assistant Examiner*—Diab Hamadi

[57] ABSTRACT

A tension mask color cathode ray tube includes a glass faceplate having on its inner surface a centrally disposed, rectangular screening area, and on opposed sides thereof a non-metal shadow mask support structure of predetermined Q-height. The mask support structure has a metal element embedded in the apex of the structure. The apex of the structure and the metal element are ground to define a surface for receiving a tensed foil shadow mask. The surface contains a metal portion to which the mask may be welded, and a non-metal portion which supports the metal portion.

9 Claims, 3 Drawing Sheets

MASK SUPPORT STRUCTURE FOR TENSION MASK COLOR CATHODE RAY TUBES

CROSS-REFERENCE TO RELATED APPLICATIONS

This application is a continuation-in-part of application Ser. No. 566,721 filed Aug. 13, 1990. It is related to but in no way dependent upon copending applications Ser. No. 454,223 filed Dec. 21, 1989; Ser. No. 458,129 filed Dec. 28, 1989; and Ser. No. 427,149 filed Oct. 24, 1989, common ownership herewith.

BACKGROUND OF THE INVENTION

1. Field of the Invention

This invention relates to color cathode ray picture tubes, and is addressed specifically to the manufacture of tubes having shadow masks of the tension foil type in association with a substantially flat faceplate. The invention is useful in the manufacture of color tubes of various types, including those used in home entertainment television receivers, and in medium-resolution and high-resolution tubes intended for color monitors.

The tension foil shadow mask is a part of the cathode ray tube front assembly, and is located in close adjacency to the faceplate. As used herein, the term "shadow mask" means an apertured metallic foil which may, by way of example, be about 0.001 inch thick, or less. The mask is supported in high tension a predetermined distance from the inner surface of the faceplate; this dimension is known as the "Q-height." As is well known in the art, the shadow mask acts as a color-selection electrode, or "parallax barrier," that ensures that each of the three beams generated by the electron gun located in the necl: of the tube lands only on its assigned phosphor deposits.

2. Prior Art

U.S. Pat. Nos. 4,908,995; 4,891,546; 4,828,523; 4,828,524; 4,790,786; 4,745,330; 4,828,523; and 4,737,681, all of common ownership herewith.

OBJECTS OF THE INVENTION

It is a general object of the invention to provide means and process for use in the manufacture of tension mask color cathode ray tubes that simplify production and reduce production costs.

It is an object of the invention to provide improved means and process for mounting a tensed foil shadow mask on the faceplate of a tension mask color cathode ray tube.

It is another object of the invention to provide an improved support structure and process for mounting a tensed foil shadow mask in association with a substantially flat faceplate.

It is a specific object of the invention to provide a shadow mask support structure that is mechanically rigid, easy to manufacture, and in which material and production costs are minimized.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
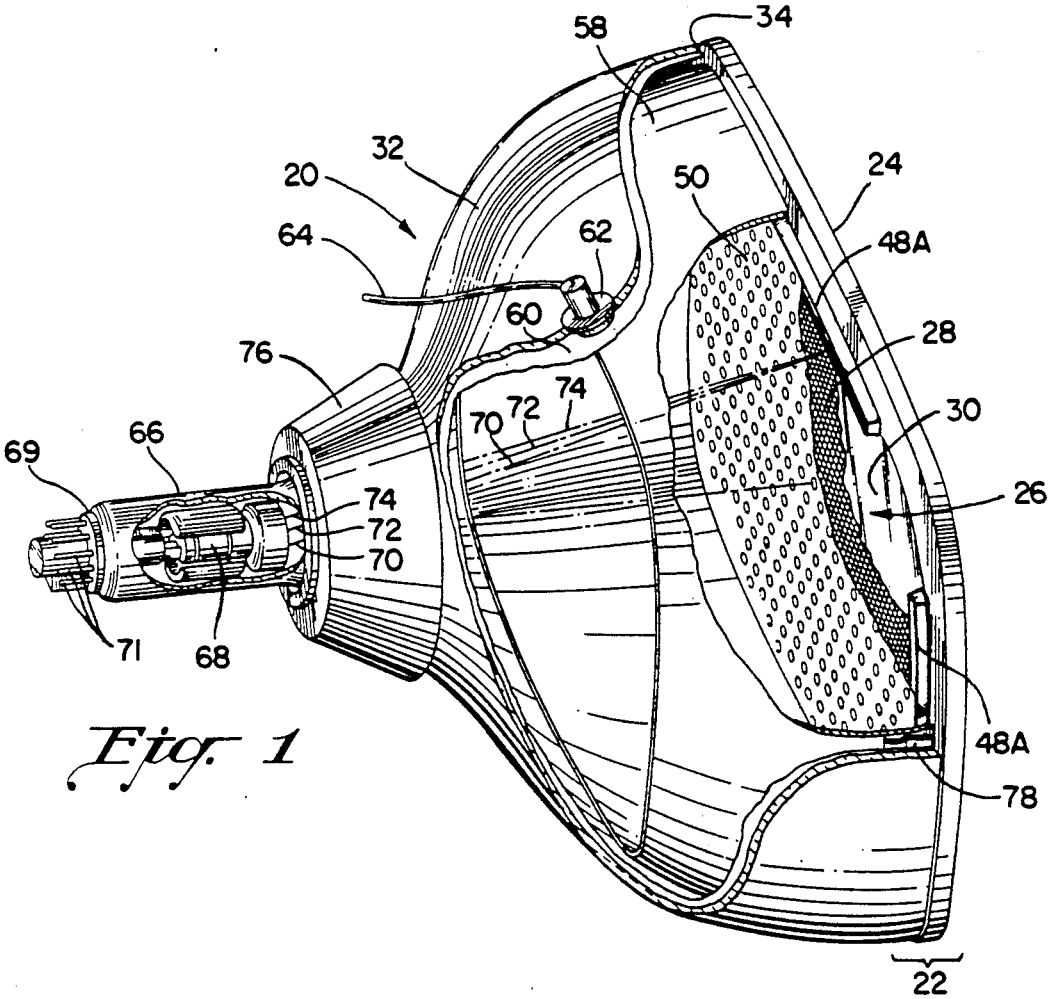
FIG. 1 is a side view in perspective of a tension mask color cathode ray tube having a prefabricated mask support structure subject to the means and process according to the invention, with cutaway sections that indicate the location and relationship of the major components of the tube.
Figure 2:
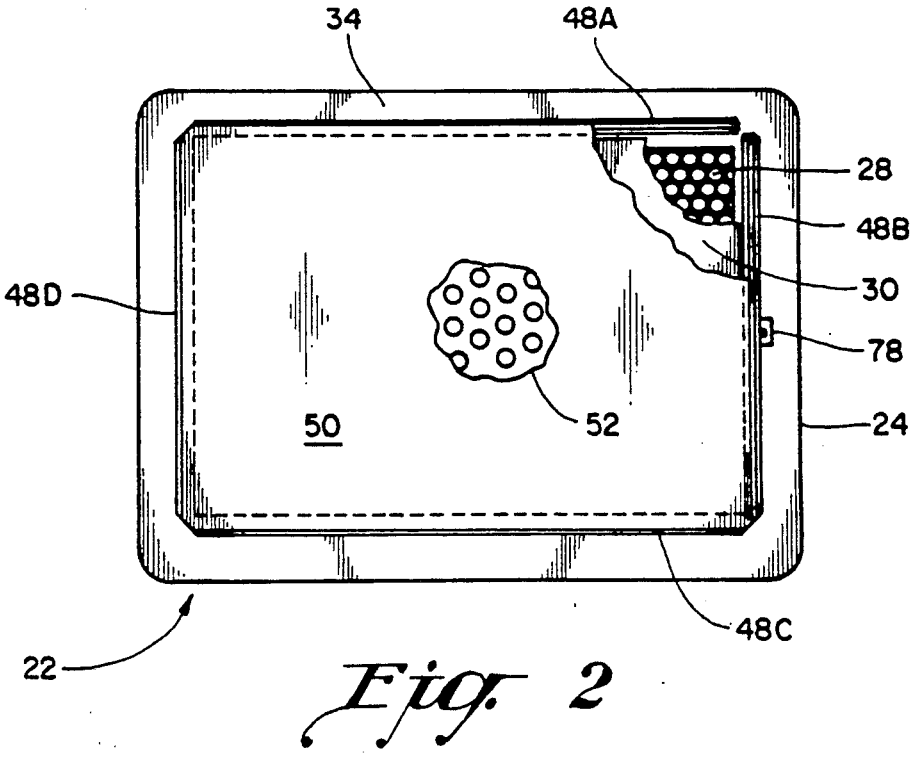
FIG. 2 is a plan view of the front assembly of a flat tension mask color cathode ray tube depicted in FIG. 1, with parts cut away to show the relationship of the faceplate with the mask support structure and shadow mask; insets show mask apertures and phosphor screen patterns greatly enlarged.

A color cathode ray tube having a tension mask support structure invention is depicted in FIGS. 1 and 2. The tube and its component parts are identified in the figures, and described in the following paragraphs in this sequence: reference number, a reference name, and a brief description of structure, interconnections, relationship, functions, operation, and/or result, as appropriate.

20: tension mask color cathode ray tube
22: front assembly
24: glass faceplate
26: inner surface of faceplate
28: centrally located phosphor screen on inner surface 26 of faceplate 24; the round deposits of phosphor, shown as surrounded by the black matrix, are depicted greatly enlarged; the screen is also referred to as "the screening area"
30: film of aluminum
32: funnel
34: peripheral sealing area of faceplate 24, adapted to mate with the peripheral sealing area of the mouth of funnel 32
48: mask support structure according to the invention; the structure may be "unitary" in that it can be installed as a prefabricated unit in a foil tension mask cathode ray tube, or it may comprise four discrete parts located on opposed sides of the screen 28, as indicated by FIG. 2. The mask-receiving surface may be preground to provide a planar surface before installation of the structure
50: metal foil shadow mask; after being tensed, the mask is mounted on mask support structure 48 and secured thereto
52: shadow mask apertures, indicated as greatly enlarged in the inset for illustrative purposes; there is one aperture for every triad of phosphor deposits
58: magnetic shield, internal (a shield, not shown, may also be installed external to the tube envelope)
60: internal conductive coating on funnel
62: anode button
64: high-voltage conductor
66: neck of tube 68: in-line electron gun providing three discrete in-line electron beams 70, 72 and 74 for exciting respective red-light-emitting, green-light-emitting and blue-light-emitting phosphor deposits on screen 28

69: base of tube

71: metal pins for conducting operating voltages through the base of the tube 69 to the electron gun 68

76: yoke which provides for the traverse of beams 70, 72 and 74 across screen 28

78: contact spring which provides an electrical path between internal funnel coating 60 and the mask support structure 48.

Figure 3:
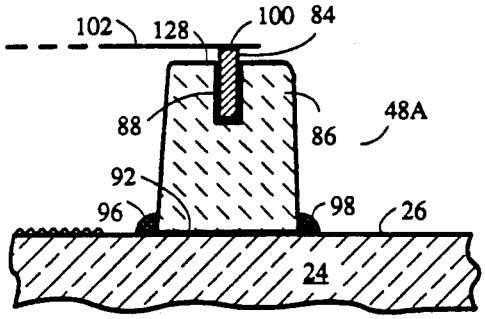
FIGS. 3–6 are cross-sectional detail views in elevation of preferred embodiments of shadow mask support structures according to the invention of the parent application.

FIG. 3 depicts, by way of example, a mask-support structure 48A having a mask-receiving member 84 embedded therein. The mask-support structure is indicated in FIG. 2 as being located on opposed sides of the centrally disposed, rectangular screening area. The body 86 of mask-support structure 82 is composed of a ceramic, and the mask-receiving member 84 of a metal, preferably a metal alloy. Mask-support structure 82, which is substantially rectangular, has a recess 88 therein noted as being lengthwise. The mask-receiving member is cemented in the recess.

Support structure 82 is attached to the inner surface 26 of faceplate 24; attachment is by means of a devitrifying solder glass which is applied in paste form to the base 92 of structure 82. The base 92 is placed in contact with the inner surface 26 of faceplate 24, and the assemblage is heated to a temperature of about 460 degrees C. The solder glass melts and devitrifies, and upon cooling, provides for permanent attachment of the structure to the faceplate. The thickness of the solder glass between the base 92 of structure 82 and the inner surface 26 of faceplate 24 is preferably about 0.005 inch. The excess solder glass appears in the form of fillets 96 and 98 which serve to reinforce the attachment of structure 82 to faceplate 24. The solder glass may comprise, by way of example, solder glass No. CV-685 manufactured by Owens-Illinois of Toledo, Ohio.

The mask-receiving member is cemented into the recess. Uncured cement, that is, cement in other than solid form, is inserted into recess 88, then a mask-receiving member adapted to fit the recess is inserted into the recess. The cement is then allowed to cure to permanently secure the mask-receiving member in the recess. The cement comprises a devitrifying solder glass which is inserted into the recess in paste form. When heated to a temperature of about 460 degrees C., the solder glass melts and devitrifies, permanently securing the mask-receiving member into the recess. The solder glass may be the same as that specified in the foregoing for cementing the support structure to the faceplate, that is, solder glass No. CV-685. The thickness of the cement that encloses the mask-receiving member is of the order of 0.005 inch.

Mask-receiving member 84 is indicated as being a rectangular strip of metal having an edge 100 for receiving and securing a tensed foil shadow mask 102. The thickness of member 84 is in the range of 0.015 to 0.030 inch. Mask 102 is preferably secured to edge 100 by laser welding, a procedure fully described and claimed in U.S. Pat. No. 4,828,523, of common ownership herewith.

It is to be noted that the general conformation of the mask support structures and associated parts and means of attachment depicted in FIGS. 4–8 are identical to that shown by FIG. 3, except for the difference in the shape of the mask-receiving member and its interface with the body of the support structure. To simplify the following description of further embodiments of mask support structures, only those differences will be cited in the following.

Figure 4:
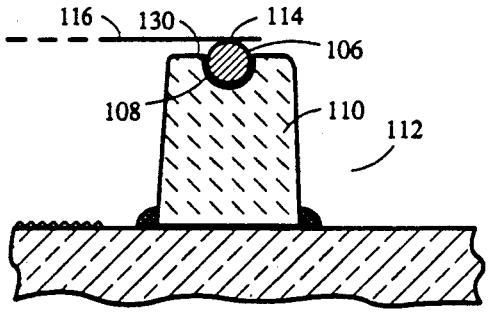

The mask-receiving member may also comprise a wire, as indicated by mask-receiving member 106 in FIG. 4. It will be noted that the recess 108 in the body 110 of mask support structure 112 is contoured to accept the circular configuration of member 106. The surface 114 that provides for receiving and securing shadow mask 116 is preferably ground to a flat about 0.030 inch wide; a production-tested procedure for grinding a metal mask-receiving surface is set forth in U.S. Pat. No. 4,908,995, of common ownership herewith.

Figure 5:
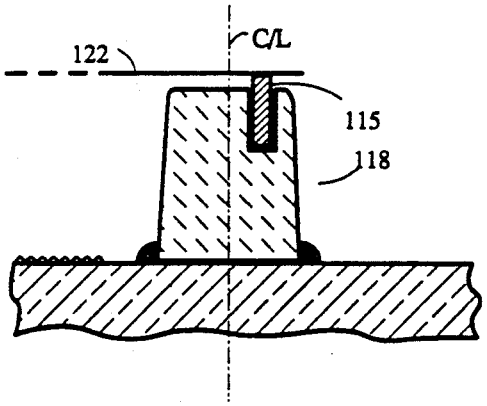
Figure 6:
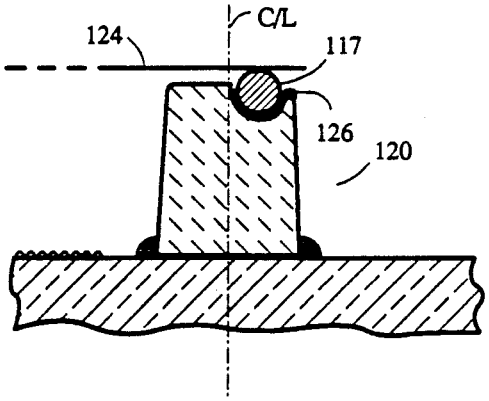

As shown in FIGS. 5 and 6, a mask-receiving member may be displaced outwardly from the centerline (C/L) of the structures, that is, away from the screening surface. Such displacement is indicated by the outward displacement of mask-support members 115 and 117 in respective mask-support structures 118 and 120. By displacing the mask-receiving members as indicated, the members are more resistant to the inward pull of respective shadow masks 122 and 124, which are under a tension of about 30,000 psi. With regard to FIG. 6, an additional deposit of cement 126 provides for additional reinforcement of the structure and its attachment to the mask-receiving member 117.

THE PRESENT INVENTION

Figure 7:
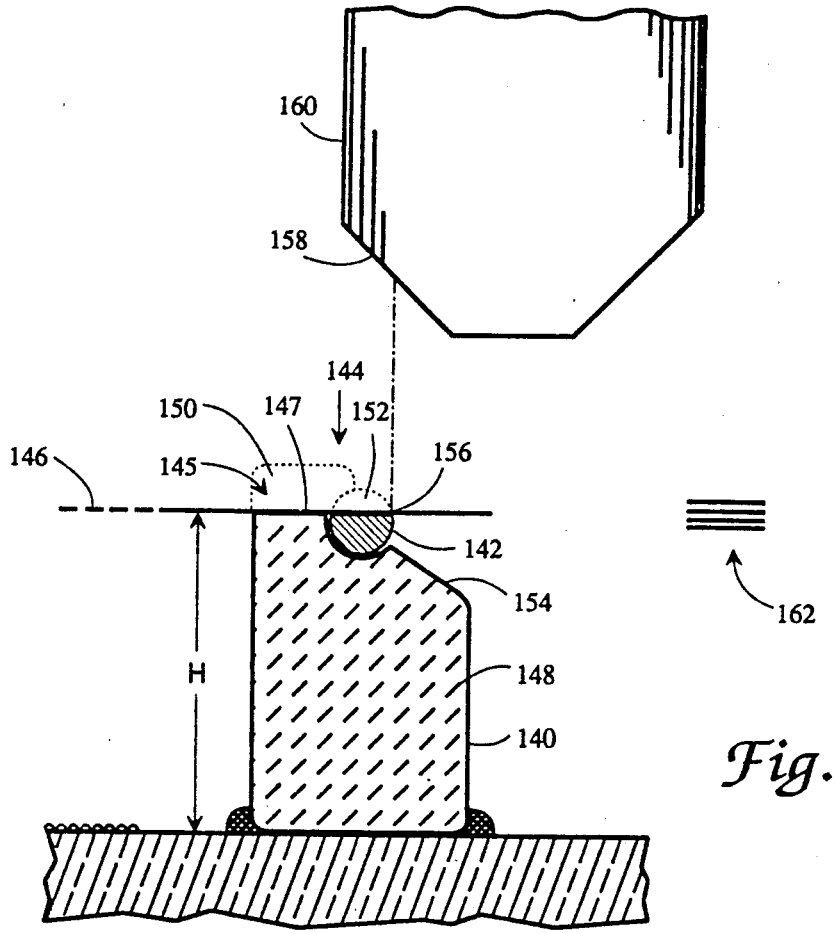
FIGS. 7 and 8 are cross-sectional detail views in elevation of preferred executions of a mask support structure according to the present invention in conjunction with a probe for mapping the contour of the mask receiving surface of the structure.

With reference now to FIG. 7, there is depicted a non-metal shadow mask support structure 140 indicated as comprising a ceramic material of predetermined Q-height "H". Mask support structure 140 has a metal element 142 embedded in an apex 144, or summit, thereof, and shown as being a round wire. The apex 144 of mask-support structure 140 and metal element 142 is ground to define surface 145 for receiving tensed foil shadow mask 146. Surface 145 is noted as containing a metal portion—metal element 142—to which mask 146 may be welded, and a non-metal portion comprising the body 148 of support structure 140 which supports the metal portion. Metal element 142 is affixed to structure 140 by means of devitrifying solder glass, as described heretofore.

It was formerly believed that it was impractical, if not impossible, to grind into the ceramic body of a mask support structure without creating cracks or fissures, or open pores that encourage breakage or the evolution of a tube-contaminating gas during subsequent processing of the tube.

The shape of the ceramic body 148 of mask support structure 140 and metal element 142 before the grinding of apex 144 to form surface 145 is indicated by the sections enclosed by dotted lines; i.e., section 150 of ceramic body 148 and section 152 of metal element 142. The subsequent shape provides a large wrap angle of the ceramic about the wire, and facilitates fixturing during firing of the solder glass. The excess of metal and ceramic can readily be ground off to provide the proper Q-distance "H".

Mask support structure 140 has an angular side 154 falling away from an edge 156 of metal element 142. The purpose of angular side 154 is to provide access of edge 156 to an edge 158 of a mapping probe 160. The purpose of probe 160 is to detect the top and an edge of a mask-receiving surface such as the edge 156 of metal element 142. The coordinates are recorded and the path of an attachment device (a welding head, e.g.) is delineated for use in affixing a tensed foil shadow mask to a mask-receiving surface. The rail mapping method and apparatus are fully described and claimed in U.S. Pat. No. 4,828,524, of common ownership herewith.

The desired Q-height "H" is obtained by grinding the non-metal body 148 and metal element 142 to a predetermined depth to provide the desired surface 145 on the non-metal body 148 and metal element 142 for receiving the tensed foil shadow mask 146; the various grinding-depth options are indicated diagrammatically by scale 162. It is not considered expedient to remove more than one-half the area of the metal element 142 as the area of attachment of the element 142 to the non-metal body 148 of support structure 140 will be reduced too greatly, and the bond between the two will be weakened.

Figure 8:
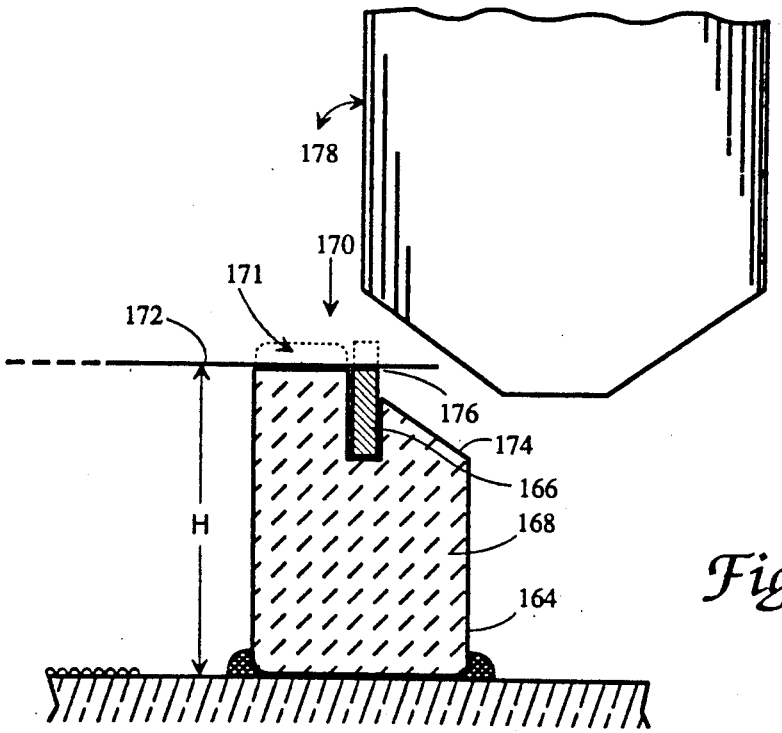

With reference to FIG. 8, there is depicted a shadow mask support structure 164 very similar in configuration to the structure 140 shown by FIG. 7. In lieu of a round wire as the metal element, a rectangular metal strip 166 is embedded in the apex 170 of support structure 164. The apex 170 of mask support structure 164 and metal strip 166 is ground to define a surface 171 at a predetermined Q-height "H" for receiving a tensed foil shadow mask 172. Surface 171 contains the metal strip 166 to which mask 172 is welded, and a non-metal (ceramic) portion which supports strip 166 to provide a predetermined Q-height "H". Angular side 174 falls away from an edge 176 of metal strip 166 to provide access to edge 176 by a mapping probe 178, as described in connection with FIG. 7. Metal strip 166 is affixed to structure 164 by means of devitrifying solder glass.

The material of the mask-receiving metal elements—elements 84, 106, 115 and 117 depicted by FIGS. 3–6, and elements 142 and 166 shown by FIGS. 7 and 8—comprises an alloy having a coefficient of thermal contraction compatible with the non-metal, ceramic material of the bodies of the support structures. A suitable material is Alloy No. 27 manufactured by Carpenter Technology of Reading, Pa. It has a CTC (coefficient of thermal contraction) of approximately 105 to $109\times10^{-7}$ in/in/degree C. over the range of the temperatures required for devitrification of the solder glass used to cement the tube components together. This range of temperature is from ambient to 460 degrees C. Alloys having equivalent characteristics supplied by other manufacturers may as well be used.

The ceramic material of the support structures is a form of forsterite. A preferred composition comprises:

Talc ($MgO+SiO_2$), 62%
Magnesia (MgO), 28%
Ball Clay, 4%
Barium Carbonate, 6%
Total: 100%

The mask support structures are preferably made by extruding the ceramic in the form of "rails" having the desired contour. The recess in the structure, as typified by recess 88 in FIG. 3, can be formed during the extrusion process. After extrusion, the ceramic is in a "green" state, and must be fired to harden and devitrify it and impart maximum strength.

With regard to dimensions, and by way of example: mask-receiving metal element 84 in FIG. 3 projects above the top surface 128 of the non-metal body 86 of support structure 48A by about 0.015 inch, and the depth of recess 88 is about 0.050 inch. The diameter of the round wire 106 depicted in FIG. 4 is about 0.060 inch, and it projects above the top surface 130 of support structure 112 about 0.015 inch. The "Q-height" of the structures—that is, the distance between the inner surface of the faceplate and the mask-receiving surface—is about 0.290 inch, and the width of the structure at the base about 0.220 inch.

The benefits provided by the mask-support structure include simplification of the structure, reduced use of costly alloys, and lower manufacturing costs. The mask-support members, which comprise a metal wire and a metal strip, are easily formed by standard metal-working techniques. Minimum amounts of metal are used, providing not only cost savings, but also a weight reduction. A further benefit lies in the fact that the process of attaching a metal strip or a wire to the ceramic of the support structure is simplified, and the resulting bond is much stronger.

The round wire configuration provides the most economical rail material as its cost per pound (or, per cubic inch) is lowest. Another reason for the lower cost of the round wire is that no secondary operation is required as with a metal strip, which must be rolled flat from round wire. Any elaborate operations machining operations such as roll forming, slitting or bending add significantly to costs.

While a particular embodiment of the invention has been shown and described, it will be readily apparent to those skilled in the art that changes and modifications ma be made in the inventive apparatus and process without departing from the invention in its broader aspects, and therefore, the aim of the appended claims is to cover all such changes and modifications as fall within the true spirit and scope of the invention.

We claim:

1. A tension mask color cathode ray tube including a glass faceplate having on its inner surface a centrally disposed, rectangular screening area, and on opposed sides thereof, a non-metal shadow mask support structure of predetermined Q-height, said mask-support structure having a metal element embedded in an apex thereof, with the apex of said mask-support structure and said element being ground to define a surface for receiving a tensed foil shadow mask that contains a metal portion to which said mask may be welded, and a non-metal portion which supports said metal portion.

2. A tension mask color cathode ray tube including a glass faceplate having on its inner surface a centrally disposed, rectangular screening area, and on opposed sides thereof, a non-metal shadow mask support structure of predetermined Q-height, said mask-support structure having a metal element embedded in an apex thereof, with the apex of said mask-support structure and said metal element being ground to define a surface for receiving a tensed foil shadow mask that contains a metal portion to which said mask may be welded, and a non-metal portion which supports said metal portion, said mask support structure having an angular side falling away from an edge of said metal element to provide access to said edge by a mapping probe.

3. A tension mask color cathode ray tube including a glass faceplate having on its inner surface a centrally disposed, rectangular screening area, and on opposed sides thereof, a non-metal shadow mask support structure of predetermined Q-height, said mask-support structure having a metal wire embedded in an apex thereof, with the apex of said mask-support structure and said wire being ground to define a surface for receiving a tensed foil shadow mask that contains a metal wire to which said mask may be welded, and a non-metal portion which supports said metal wire.

4. A tension mask color cathode ray tube including a glass faceplate having on its inner surface a centrally disposed, rectangular screening area, and on opposed sides thereof, a non-metal shadow mask support structure of predetermined Q-height, said mask-support structure having a rectangular metal strip embedded in an apex thereof, with the apex of said mask-support structure and said strip being ground to define a surface for receiving a tensed foil shadow mask which contains a metal strip to which said mask may be welded, and a non-metal portion which supports said strip.

5. For use in the manufacture of a tension mask color cathode ray tube including a faceplate having an inner surface for receiving a shadow mask support structure on opposed sides of a centrally located screen, a process comprising:

forming a non-metal mask-support structure and embedding a metal element in the apex thereof;

securing said mask-support structure to said inner surface;

grinding the apex of said structure and said element to define a surface that contains a metal portion and a non-metal portion which supports said metal portion; and welding a shadow mask to said metal portion.

6. The process according to claim 5 including forming said metal element as a wire.

7. The process according to claim 5 including forming said metal element as a rectangular metal strip.

8. The process according to claim 5 including forming said non-metal mask-support structure as a ceramic material.

9. For use in the manufacture of a tension mask color cathode ray tube including a faceplate having an inner surface for receiving a shadow mask support structure on opposed sides of a centrally located screen, a process comprising:

forming a non-metal mask-support structure and embedding a metal element in the apex thereof;

securing said mask-support structure to said inner surface;

grinding the apex of said structure and said element to define a surface that contains a metal portion, and a non-metal portion which supports said metal portion;

providing angular clearance on a side of said mask-support structure for access to an edge of said metal portion by a mapping probe;

welding a shadow mask to said metal portion.

* * * * *